United States Patent [19]

Pasternak

[11] 4,369,833

[45] Jan. 25, 1983

[54] TUBE SUPPORTS

[75] Inventor: Stephen F. Pasternak, Park Ridge, Ill.

[73] Assignee: Peerless of America, Inc., Chicago, Ill.

[21] Appl. No.: 108,813

[22] Filed: Dec. 31, 1979

[51] Int. Cl.[2] ..... F28F 9/00

[52] U.S. Cl. ..... 165/67; 248/68 R; 248/49

[58] Field of Search ..... 248/49, 68 R, 232, 233, 248/234, 67, 99, 76; 165/76, 181-183

[56] References Cited

U.S. PATENT DOCUMENTS

| | | | |
|---|---|---|---|
| 1,905,596 | 4/1933 | Lewis | 248/49 |
| 2,337,899 | 12/1943 | Kent et al. | 248/49 |
| 3,692,105 | 9/1972 | O'Connor | 165/181 |
| 4,098,327 | 7/1978 | Reato | 165/76 |

FOREIGN PATENT DOCUMENTS

| | | | |
|---|---|---|---|
| 2226606 | 11/1974 | France | 248/49 |

*Primary Examiner*—William R. Cline
*Assistant Examiner*—Theophil W. Streule, Jr.
*Attorney, Agent, or Firm*—Emrich, Lee, Brown & Hill

[57] ABSTRACT

A tube support embodying a plurality of supporting members, each having grooved opposite side members with a crossbar extending therebetween, the supporting members being disposed in inter-locked relation to each other, with the crossbars being vertically spaced from each other to support tubular members thereon, and with the crossbars of upper supporting members extending down into the grooves in immediately underlying members.

10 Claims, 7 Drawing Figures

FIG. 5
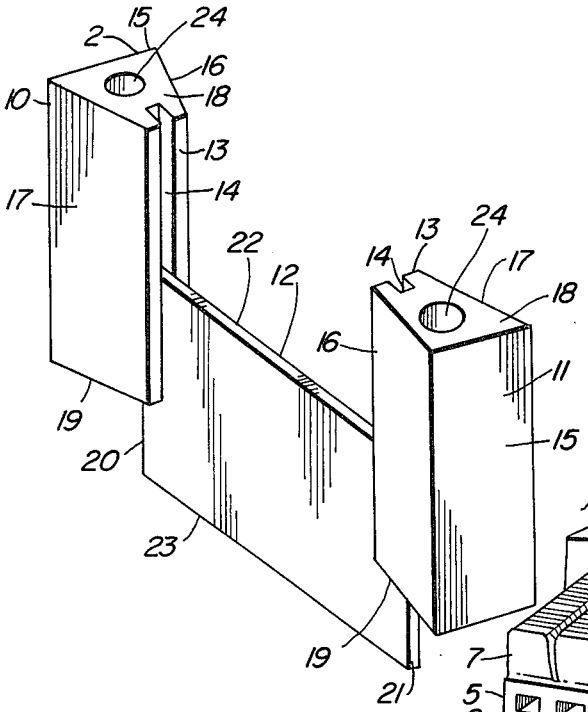
FIG. 4
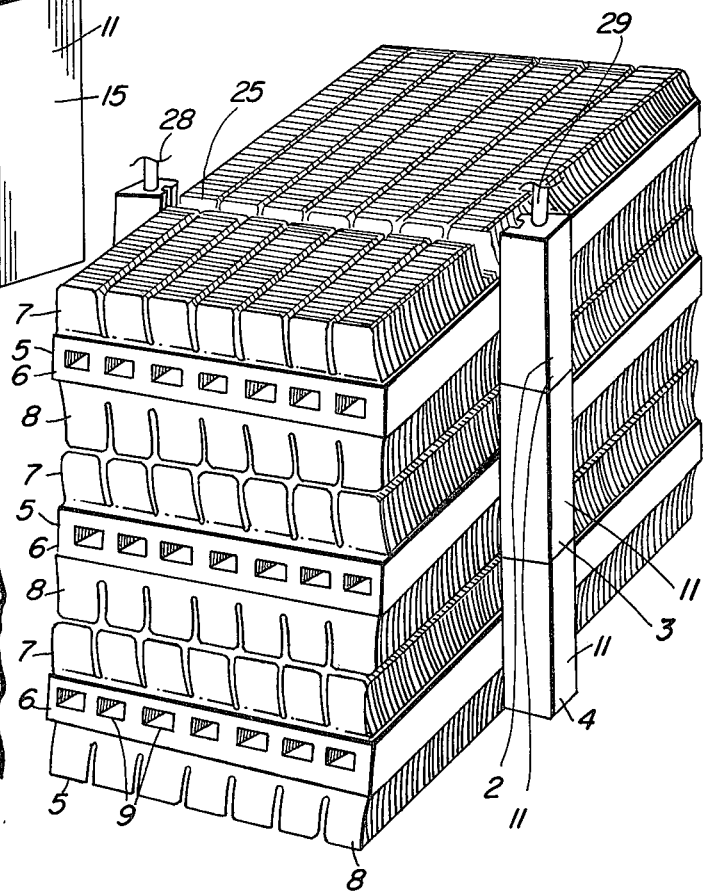
FIG. 6
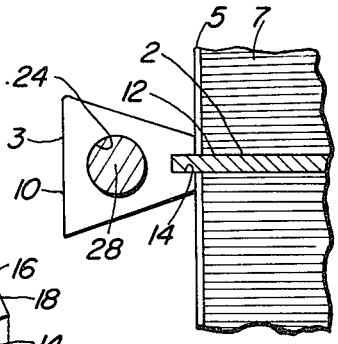
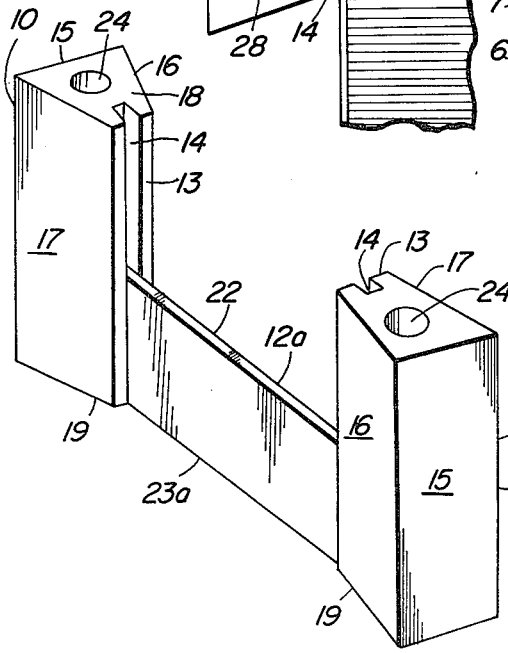
FIG. 7

TUBE SUPPORTS

BACKGROUND OF THE INVENTION

This invention relates to tube supports, and, more particularly, to supports which are particularly well adapted for intermediately supporting elongated finned tubes.

A primary object of the present invention is to afford a novel tube support.

Another object of the present invention is to afford a novel support for supporting elongated finned tubes.

Yet another object is to afford a novel support for intermediately supporting, in parallel stacked relation to each other, elongated tubes having fins projecting outwardly from the upper and lower faces thereof.

Finned tubes of the type which embody fins projecting outwardly from the upper and lower faces thereof have been heretofore known in the art, being shown, for example, in U.S. Pat. No. 3,202,212, which issued Aug. 24, 1965 to Richard W. Kritzer, and in U.S. Pat. No. 3,692,105, which issued Sept. 19, 1972 to Joseph M. O'Connor. Oftentimes such tubes are of substantial length, such as, for example, in the nature of sixty or ninety feet in length. Also, such elongated tubes are oftentimes disposed in clusters or assemblies, wherein they are disposed in parallel stacked relation to each other. Heretofore, when such pluralities of finned tubes have been supported, they commonly have been supported by individual hangers, or by shaped members that were horizontally clamped thereto, and the like. It is an important object of the present invention to afford improvements over such supports heretofore known in the art.

Another object of the present invention is to afford a novel support for supporting stacks of finned tubing in a novel and expeditious manner effective to prevent damaging engagement between the fins of adjacent tubes.

A further object of the present invention is to afford a novel support of the aforementioned type wherein the parts thereof are so constituted and arranged that the support may be quickly and easily expanded or retracted in size for accommodating a greater or lesser number of tubes, respectively.

Another object of the present invention is to afford a novel support of the aforementioned type which embodies novel individual parts that may be quickly and easily assembled into various assemblies.

Another object of the present invention is to afford a novel tube support of the aforementioned type which embodies novel parts constituted and arranged in a novel and expeditious manner.

A further object of the present invention is to afford a novel support of the aforementioned type which is practical and efficient in operation, and which may be readily and economically produced commercially.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

In the drawings:

FIG. 4 is a front perspective view, similar to FIG. 1, but showing the complete assembly of tubes and support, shown in FIG. 2;

FIG. 5 is a perspective view of one of the supporting members of the tube support shown in FIG. 1;

FIG. 6 is a fragmentary detail sectional view taken substantially along the line 6—6 in FIG. 2; and FIG. 7 is a perspective view of another supporting member embodied in the tube support shown in FIG. 1.

DESCRIPTION OF THE EMBODIMENT SHOWN HEREIN

Figure 1:
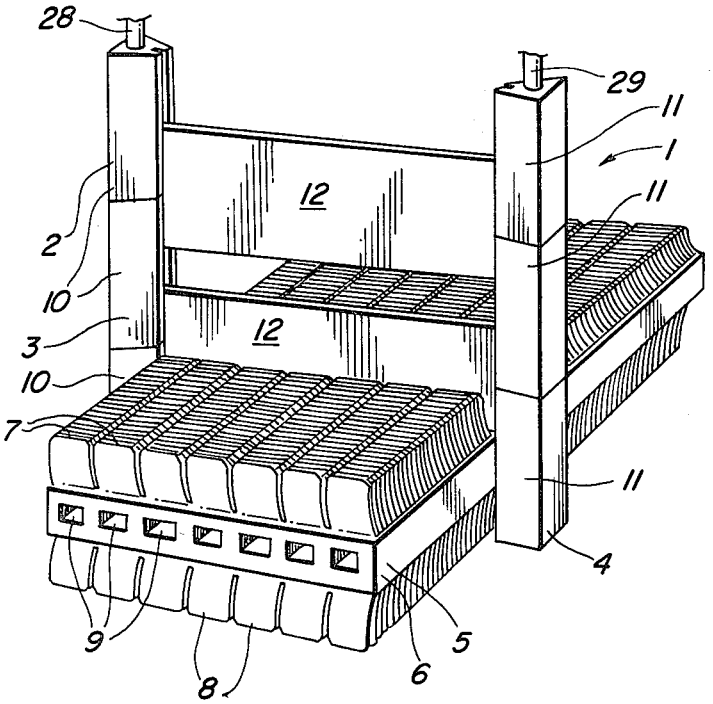
FIG. 1 is a front perspective view of a tube support, embodying the principles of the present invention, showing one tube, of a complete assembly of tubes, disposed in operative position therein.

A finned-tube support 1, embodying the principles of the present invention, is shown in the drawings to illustrate the presently preferred embodiment of the present invention.

Figure 2:
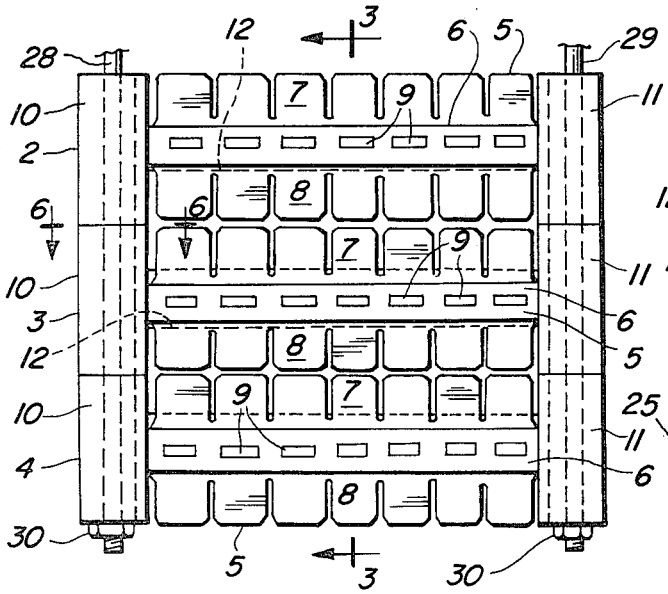
FIG. 2 is a front elevational view of the support shown in FIG. 1, with a complete assembly of three tubes disposed therein.

The support 1, shown in the drawings, embodies three elongated supporting members 2, 3 and 4, FIGS. 1, 2 and 4, disposed in stacked relation to each other in position to support the intermediate portions of three elongated heat exchangers, in the form of finned tubes 5, each of which embodies an elongated body portion 6 having fins 7 and 8 projecting outwardly from the upper and lower faces thereof, respectively, FIG. 4. The finned tubular members 5 are of the multi-port type, such as that shown in the aforementioned Kritzer U.S. Pat. No. 3,202,212, having a plurality of passageways 9 extending through the body portion 6 thereof, FIGS. 2 and 4. This is merely by way of illustration and not by way of limitation, and the finned tubes 5 may be of different construction, such as, for example, embodying a single passageway therethrough, such as, for example, in the heat exchanger shown in the aforementioned O'Connor U.S. Pat. No. 3,692,105, without departing from the purview of the broader aspects of the present invention.

The supporting members 2-4 may be made of any suitable material, such as, for example, aluminum, and the supporting members 2 and 3 are identical in construction, each embodying two oppositely disposed, elongated side members 10 and 11, with an elongated intermediate member or crossbar 12 extending between the side members 10 and 11, FIG. 5.

The side members 10 and 11 of each of the supporting members 2 and 3 are identical in construction, except that they are mirror images of each other. Each embodies an inner face 13, having an intermediate groove 14 formed therein and extending the length thereof, an outer face 15, two oppositely disposed side faces 16 and 17, and two substantially horizontally extending, parallel upper and lower faces 18 and 19, respectively, FIG. 5.

The crossbar 12, of each of the supporting members 2 and 3, is in the form of a substantially flat plate, and the opposite end portions 20 and 21 thereof are disposed in the lower end portions of the grooves 14 in the side members 10 and 11, respectively, with the upper edge portion 22 disposed in downwardly spaced relation to the upper edges of the grooves 14, and with the lower edge portions 23 projecting downwardly below the lower faces 19 of the respective side members 10 and 11 for a purpose which will be discussed in greater detail presently.

Each of the side members 10 and 11 also embodies an elongated opening 24 extending longitudinally therethrough in centered position between the grooves 14 and the outer face 15 and between the side faces 16 and 17 of the respective side members 10 and 11. In the preferred form of the invention shown in the drawings, the openings 24 are round in transverse cross sectional shape.

The side members 10 and 11 of the supporting member 4 are identical in construction to the side members 10 and 11 of the supporting members 2 and 3, and the various portions thereof are indicated by the same reference numerals as the corresponding portions of the side members 10 and 11 of the supporting members 2 and 3. However, in the supporting member 4, the intermediate member or crossbar 12*a* is somewhat different in size and construction from the crossbar 12 of the supporting members 2 and 3, the lower edge portion 23*a* thereof terminating in uniplanar relation to the lower faces 19 of the side members 10 and 11 of the supporting member 4, for a purpose which will be discussed in greater detail presently. Otherwise, the crossbar 12*a* of the supporting member 4 is the same in construction as the crossbar 12 of the supporting members 2 and 3, and it is mounted in the side members 10 and 11 of the supporting member 4 in the same manner as that in which the cross members 12 of the supporting members 2 and 3 are mounted in the side members 10 and 11 thereof. The crossbars 12 and 12*a* may be secured to the respective side members 10 and 11, in which they are mounted, by any suitable means, such as, for example, by soldering.

When the supporting members 2–4 are disposed in assembled position to afford the tube support 1, they are disposed in stacked relation to each other with the side members 10 and 11 of the supporting members 3 and 2 resting on top of the side members 10 and 11 of the side members 4 and 3, respectively, in axially aligned relation to each other. In this position of the supporting members 2–4, the openings 24 through each of the side members 10 and 11, respectively, are disposed in axial alignment with each other, and the crossbars 12 of the supporting members 3 and 2 are disposed in the upper end portions of the grooves 14 in the supporting members 4 and 3, respectively, FIG. 1. In this arrangement of the supporting members 2–4, they are well adapted for supporting three stacked heat exchangers 5, as shown in FIGS. 2 and 4, with the lowermost heat exchanger 5 disposed between the crossbar 12*a* of the supporting member 4 and the crossbar 12 of the supporting member 3; the intermediate heat exchanger 5 disposed between the crossbar 12 of the supporting member 3 and the crossbar 12 of the supporting member 2; and the upper heat exchanger 5 resting on top of the crossbar 12 of the supporting member 2, as will be discussed in greater detail hereinafter.

In the preferred form of the invention shown in the drawings, outer end portions of oppositely disposed upper fins 7 and lower fins 8 on each of the heat exchangers 5 are cut away, or otherwise removed, to form elongated grooves or recesses 25 and 26, respectively, to accommodate engagement with the crossbars 12 or 12*a*. Each of the recesses 25 and 26 extends longitudinally across the full lateral width of the respective heat exchanger 5 in which it is formed. Preferably, the thickness of each of the recesses 25 and 26 is only slightly larger than the thickness of the crossbars 12 and 12*a*, and only the outer end portions of the fins 7 and 8 are removed, thus leaving fin stubs 27 defining the inner longitudinal sides of the respective recesses 25 and 26, FIG. 3.

Figure 3:
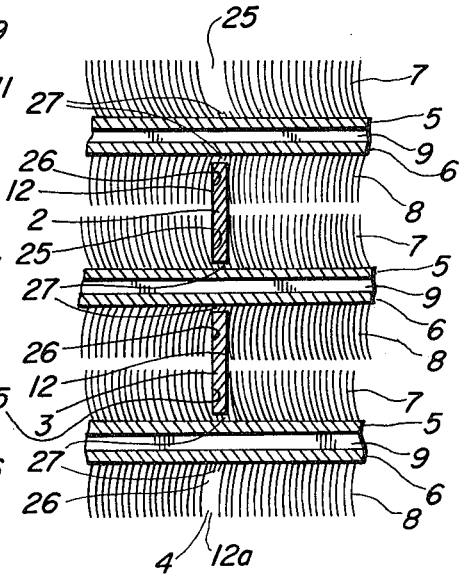
FIG. 3 is a transverse cross sectional view taken substantially along the line 3—3 in FIG. 2.

With this construction of the supporting members 2–4 and the heat exchangers 5, when the heat exchangers 5 are disposed in assembled position in the tube support 1, as shown in FIGS. 2–4, the lowermost heat exchanger 5 rests on the upper edge 22 of the crossbar 12*a* of the lowermost supporting member 4, with the crossbar 12*a* disposed in the recess 26 thereof and supportingly engaging the fin stubs 27 defining the inner edge of this recess 26; the intermediate heat exchanger 5 is disposed between the crossbar 12 of the supporting member 3 and the crossbar 12 of the supporting 2, with the upper edge portion of the crossbar 12 of the supporting member 3 extending upwardly into the recess 26 of the intermediate heat exchanger 5, into supporting engagement with the fin stubs 27 therein, and with the crossbar 12 of the supporting member 2 projecting downwardly into the recess 25 of the intermediate heat exchanger 5, into abutting engagement with the fin stubs 27 defining the inner edge of this recess 25; and the upper heat exchanger 5 rests on top of the crossbar 12 of the supporting member 2, with the upper edge 22 of the last mentioned crossbar 12 projecting upwardly into the recess 26 in the upper heat exchanger 5, into abutting engagement with the fin stubs 27 defining the inner edge of this last mentioned recess 26.

In the preferred form of the tube support 1 shown in the drawings, the crossbars 12 and 12*a* are disposed on their respective side members 10 and 11 in such position that the upper fins 7 of the upper heat exchanger 5 terminate at their outer edges in substantially uniplanar relation to the upper face 18 of the side members 10 and 11 of the upper supporting member 2; the lower fins 8 of the lowermost heat exchanger 5 terminate at their outer ends in substantially uniplanar relation to the lower faces 19 of the side members 10 and 11 of the lowermost supporting member 4; and the adjacent fins 7 and 8 of the adjacent heat exchangers 5 are disposed in closely adjacent, vertically spaced relation to each other, FIGS. 2 and 4.

In the assembled form of the tube support 1, shown in the drawings, two elongated members 28 and 29 are disposed in and extend longitudinally through the aligned openings 24 in the aligned side members 10 and 11, respectively, FIGS. 2 and 4. In the form shown, the elongated members 28 and 29 constitute hanger rods having nuts 30 disposed on the lower end portions thereof for supporting the assembly of heat exchangers 5 in the tube support 1, FIG. 2. The upper end portions of the hanger rods 28 and 29 may be secured to any suitable overhead support, not shown.

As will be appreciated by those skilled in the art, the hanger rods 28 and 29 are shown herein merely by way of illustration and not by way of limitation, and other elongated members, such as, for example, bolts, not shown, may be inserted through the openings 24 without departing from the purview of the broader aspects of the present invention. The elongated members 28 and 29 not only afford members which may be used to vertically support the assembled heat exchangers 5 and tube support 1, but also act as holding members for assisting in preventing the lateral shifting of the supporting members 2–4 relative to each other as well as such lateral shifting of the heat exchangers 5 relative to each other.

From the foregoing it will be seen that the present invention affords a novel tube support which is particularly well adapted for supporting stacks of finned tubing.

In addition, it will be seen that the present invention affords a novel tube support, the parts of which are so constituted and arranged that it may be readily converted to support a greater or smaller number of tubes, by merely increasing or decreasing the number of supporting members, such as the supporting members 2 and 3, which are disposed in stacked relation to each other in the assembled support 1.

In addition, the present invention affords a novel tube support, which is well adapted for use in the intermediate supporting of elongated tubular members, such supports readily being embodied into an assembly of such stacked tubes, at suitable intervals, such as, for example, every two feet, or the like, along the intermediate length of such tubes.

Also, it will be seen that the present invention affords a novel tube support of the aforementioned type, wherein the parts thereof are effectively inter-locked together in a novel and expeditious manner.

Also, it will be seen that the present invention affords a novel tube support of the aforementioned type which is practical and efficient in operation and which may be readily and economically produced commerically.

Thus, while I have illustrated and described the preferred embodiment of my invention, it is to be understood that this is capable of variation and modification, and I therefore do not wish to be limited to the precise details set forth, but desire to avail myself of such changes and alternations as fall within the purview of the following claims.

I claim:

1. A support for supporting a plurality of elongated tubes, having fins projecting from the upper and lower faces thereof, in parallel stacked relation to each other, said support comprising
   a. a plurality of supporting members
   b. each of said supporting members comprising
      (1) two oppositely disposed side members, and
      (2) an elongated crossbar extending longitudinally between said side members,
   c. said supporting members being disposed in stacked relation to each other with said side members on respective sides of said supporting members resting one on top of the other in aligned relation to each other in position to support said crossbars in spaced uniplanar relation to each other, in position to receive respective ones of such tubes on the upper edge portions of respective ones of said crossbars, and
   d. means for holding said supporting members in said stacked relation to each other.

2. A support as defined in claim 1, and in which
   a. said side members have grooves therein, and
   b. said crossbars on those of said supporting members disposed above the lowermost supporting members are disposed in said grooves in the respective underlying one of said supporting members.

3. A support as defined in claim 1, and in which
   a. said means for holding said supporting members comprise elongated members extending through said aligned side members.

4. A support as defined in claim 3, and in which
   a. said elongated members comprise hanger members for supporting said stacked supporting members from above.

5. A support as defined in claim 2, and in which
   a. said side members have openings extending therethrough,
   b. said openings in said aligned side members are disposed in alignment with each other, and
   c. said means for holding said supporting members includes elongated members extending through said aligned openings.

6. In an assembly of finned, elongated tubes, said tubes having fins projecting upwardly and downwardly therefrom, and having portions of said fins removed to afford vertically aligned, outwardly opening recesses in said upwardly and downwardly projecting fins, with said recesses disposed in substantially vertically extending uniplanar relation to each other, and said tubes being disposed in substantially horizontally extending, parallel, vertically stacked relation to each other, the combination of
   a. a plurality of supporting members,
   b. each of said supporting members comprising
      (1) two oppositely disposed side members having
         (a) inner faces disposed in facing relation to each other.
         (b) elongated grooves in and extending vertically across said inner faces, and
         (c) openings extending vertically therethrough in laterally outwardly spaced relation to said grooves, and
      (2) an elongated crossbar
         (a) extending longitudinally between said side members, and
         (b) mounted in said grooves in the latter,
   c. said supporting members being disposed in stacked relation to each other with
      (1) said openings through said side members on respective sides of said supporting members being disposed in aligned relation to each other, and
      (2) said crossbars being disposed in spaced uniplanar relation to each other,
   d. said tubes being disposed in position wherein
      (1) each of said tubes rests on top of a respective one of said crossbars, with said crossbar disposed in said downwardly opening recess in said fins of said tube, and
      (2) said crossbars above the lowermost one of said crossbars are disposed in said upwardly opening recesses in said fins on respective immediately underlying ones of said tubes, and
   e. means for holding said supporting members in said stacked relation to each other.

7. The combination defined in claim 6, and in which
   a. said crossbars on those of said supporting members disposed above the lowermost supporting member are disposed in said grooves in the respective underlying one of said supporting members.

8. The combination defined in claim 7, and in which
   a. said means for holding said supporting members includes elongated members extending through said aligned openings.

9. The combination defined in claim 7, and in which a. said crossbar on said lowermost supporting member terminates at its lower edge not substantially lower than the bottom faces of said side members of said lowermost supporting member.

10. The combination defined in claim 9, and in which a. said crossbar on said uppermost supporting member terminates at its upper edge in substantially uniplanar relation to the tops of said side members of said uppermost supporting member.

* * * * *